US006742322B2

(12) United States Patent
Qicang

(10) Patent No.: US 6,742,322 B2
(45) Date of Patent: Jun. 1, 2004

(54) PORTABLE PLASTIC FILM WRAPPING SYSTEM

(75) Inventor: Zhang Qicang, Flushing, NY (US)

(73) Assignee: Illinois Tool Works Inc., Glenview, IL (US)

( * ) Notice: Subject to any disclaimer, the term of this patent is extended or adjusted under 35 U.S.C. 154(b) by 14 days.

(21) Appl. No.: 10/120,349

(22) Filed: Apr. 12, 2002

(65) Prior Publication Data

US 2003/0192291 A1 Oct. 16, 2003

(51) Int. Cl.[7] ..... B65B 11/00

(52) U.S. Cl. ..... 53/588; 53/219; 53/399; 53/430; 403/109.6; 414/911

(58) Field of Search ..... 53/588, 218, 219, 53/399, 430; 414/911; 403/109.6, 79, 109.1, 109.2; 248/616

(56) References Cited

U.S. PATENT DOCUMENTS

| | | | | |
|---|---|---|---|---|
| 4,288,102 A | * | 9/1981 | Ramer | 280/823 |
| 4,369,614 A | | 1/1983 | Tetzner | |
| D272,540 S | | 2/1984 | Goldstein | |
| 4,938,008 A | | 7/1990 | Salzsauler | |
| 5,296,079 A | | 3/1994 | Romo | |
| 5,398,884 A | | 3/1995 | Stanford | |
| 5,423,163 A | | 6/1995 | Wendt | |
| 5,458,841 A | | 10/1995 | Shirrell | |
| 5,561,971 A | | 10/1996 | Sampson | 53/556 |
| 5,673,542 A | | 10/1997 | Vartanian et al. | 53/556 |
| 5,779,179 A | | 7/1998 | Zentmyer et al. | |
| 6,170,233 B1 | | 1/2001 | Marois et al. | 53/399 |
| 6,470,657 B2 | | 10/2002 | Huson et al. | 53/588 |
| 6,526,734 B1 | | 3/2003 | Huson et al. | 53/588 |

OTHER PUBLICATIONS

Operators Manual, MODEL G–200, Low Profile Stretch-wrap Machine, Manual Spiral Wrapper, Gerrard & Company, Apr., 1998.

* cited by examiner

*Primary Examiner*—Eugene Kim
*Assistant Examiner*—Christpher Harmon
(74) *Attorney, Agent, or Firm*—Schwartz & Weinrieb

(57) ABSTRACT

A portable plastic film wrapping system comprises a push-cart having a vertical mast member mounted thereon. A film roll carriage is vertically movable along the mast member, and the film roll carriage is operatively connected to a counterweight which is movably disposed within the mast member. The mast member is provided with a plurality of apertures, and a redundant dual stop pin assembly is engageable within particular ones of the mast member apertures so as to incrementally lockingly retain the film roll carriage at a particular elevations along the mast member such that safe controlled movement of the film roll carriage along the mast member is achieved.

23 Claims, 4 Drawing Sheets

PORTABLE PLASTIC FILM WRAPPING SYSTEM

CROSS REFERENCE TO RELATED PATENT APPLICATIONS

This patent application is related to U.S. patent application Ser. No. 09/947,364 which was filed on Sep. 7, 2001 in the name of Gale W. Huson et al. and which is entitled PORTABLE PLASTIC FILM WRAPPING SYSTEM, and is also related to U.S. patent application Ser. No. 09/814,861 which was filed on Mar. 23, 2001 in the name of Gale W. Huson et al. and which is entitled PORTABLE FILM WRAPPING SYSTEM.

FIELD OF THE INVENTION

The present invention relates generally to plastic film wrapping apparatus for wrapping palletized loads or products, and more particularly to a new and improved plastic film wrapping apparatus or system which is portable, relatively simple in structure, and readily enables the manually controlled wrapping of palletized loads or products with plastic wrapping film while ensuring a high degree of safety for operator personnel.

BACKGROUND OF THE INVENTION

As has been noted within previously filed U.S. patent application Ser. No. 09/432,284, which was filed on Nov. 2, 1999 and in the name of Hugh J. Zentmyer et al. for an APPARATUS AND METHOD FOR MANUALLY APPLYING STRETCH FILM TO PALLETIZED PRODUCTS, it is a known fact that approximately fifty percent (50%) of all stretch film that is manufactured is applied to, for example, palletized loads or products by manual means. It is also known that when applying such stretch film to, for example, palletized loads or products, the manner in which such stretch film is manually applied to such loads or products usually comprises either one of two methods. In accordance with a first one of such manual methods, as illustrated, for example, within U.S. Pat. No. 5,398,884 which issued to Stanford on Mar. 21, 1995, the operator respectively inserts four fingers of each hand into each one of two oppositely disposed recessed portions defined within the film core end caps so as to effectively hold or grasp the film roll, and while placing his thumbs upon outside surface portions of the film roll, so as to effectively cause a predetermined amount of back tension to be applied to the film whereby the film is effectively stretched as the film is being unrolled or dispensed from the film roll, the operator walks around the palletized load or product. In accordance with a second one of such manual methods of applying a stretch film to such palletized loads or products, as illustrated, for example, within U.S. Pat. No. 5,458,841 which issued to Shirrell on Oct. 17, 1995, and in lieu of directly holding or grasping the film roll, the operator holds or grasps a film roll dispensing or holding device which has a built-in tensioning mechanism. In accordance with either one of the aforenoted modes, methods, or manners in which stretch film is applied manually to the palletized products or loads, several operational drawbacks or disadvantages common to both methods or modes were apparent. Firstly, for example, the film roll, or the film roll and film roll dispensing or holding device, must be supported by the operator personnel, and yet the film roll and the film roll dispensing or holding device are quite heavy and cumbersome. In addition, in order to fully wrap a palletized load, the operator must bend down while holding the film roll, or the film roll and film roll dispensing or holding device, in order to wrap the film around the lower extremity portions of the palletized loads or products. Such requirements upon the operator personnel have been noted to cause acute discomfort, fatigue, and stress-related injuries. In addition, the operators experience fatigue and discomfort even when the operators are wrapping the upper regions of the palletized loads or products due to the continuous need for supporting the entire weight of the film roll, or the film roll and film roll dispensing or holding device.

A need therefore existed in the art for an apparatus, and for a method of operating the same, for overcoming the various operational disadvantages or drawbacks characteristic of the known PRIOR ART systems as briefly discussed hereinbefore and as disclosed within the aforenoted patents, and this need was substantially met by means of the apparatus or system, and the method of operating the same, which has been disclosed within the aforenoted U.S. patent application Ser. No. 09/432,284 and which has been quite commercially successful. However, while it has been noted in such aforenoted patent application that the apparatus or system disclosed within the aforenoted U.S. patent application Ser. No. 09/432,284 is portable in that the same is mounted upon a platform which has wheels, rollers, or the like so as to render the same movable or mobile, the apparatus is nevertheless relatively large and not readily transportable so as to, in turn, not be readily or easily movable within a particular wrapping plant or facility, or even yet further, readily or easily transportable between different wrapping plants or facilities located at different production sites.

Accordingly, the film wrapping apparatus or system disclosed within the aforenoted U.S. patent application Ser. No. 09/814,861 filed on Mar. 23, 2001 in the name of Gale W. Huson et al. for a PORTABLE FILM WRAPPING SYSTEM sought to overcome the various operational disadvantages of the known PRIOR ART and in fact successfully did so. Further improvements to such system were deemed necessary, however, in order to render such system simpler in structure, and accordingly, such improvements were in fact developed and accordingly disclosed within the aforenoted U.S. patent application Ser. No. 09/947,364 which was filed on Sep. 7, 2001 in the name of Gale W. Huson et al. and entitled PORTABLE PLASTIC FILM WRAPPING SYSTEM. While the apparatus or system as disclosed within the patent application Ser. No. 09/947,364 has operated quite satisfactorily, it has been determined still further, however, that additional improvements might optimally be incorporated within such a system in order to render the same essentially failsafe with respect to operational safety aspects for operator personnel. Occupational Safety and Health Administration (OSHA) regulations are continuously seeking to improve and ensure the occupational safety of manufacturing workplace environments in order to in fact protect operator personnel, and in accordance with the broad objectives of such regulations, it has been determined that a further need exists in the art for a new and improved film wrapping apparatus wherein the film wrapping apparatus is truly portable, transportable, simple in structure, and in effect comprises redundant safety mechanisms so as to readily enable the manual wrapping of palletized loads or products with wrapping film at a particular location within a production facility, so as to readily enable the manual wrapping of palletized loads or products with wrapping film at different locations within a particular production facility, so as to readily enable the manual wrapping of palletized loads or products with wrapping film at different production facilities, and wherein the film wrapping apparatus is relatively simple in structure and yet capable of ensuring a safe operational mode for operator personnel.

OBJECTS OF THE INVENTION

Accordingly, it is an object of the present invention to provide a new and improved apparatus or system for applying wrapping or packaging film to palletized loads or products.

Another object of the present invention is to provide a new and improved apparatus or system for applying wrapping or packaging film to palletized loads or products wherein the various operational drawbacks and disadvantages, characteristic of PRIOR ART apparatus, systems, or methods of operating the same, are overcome.

An additional object of the present invention is to provide a new and improved apparatus or system for applying wrapping or packaging film to palletized loads or products wherein the wrapping or packaging film can be applied to or wrapped around the palletized loads or products by means of operator personnel who can simply walk around the pallet upon which the loads or products are disposed and simultaneously push or guide the roll of wrapping film around the palletized loads or products whereby the palletized loads or products are accordingly packaged or wrapped within such wrapping film.

A further object of the present invention is to provide a new and improved apparatus or system for applying wrapping or packaging film to palletized loads or products wherein the wrapping or packaging film can be applied to or wrapped around the entire vertical extent of the palletized loads or products by means of operator personnel who need not support the weight of the film roll, or the film roll and the film roll dispensing mechanism, and in addition need not bend down in order to wrap or apply the stretch film upon or to the lower extremity portions of the palletized loads or products.

A still yet further object of the present invention is to provide a new and improved apparatus or system for applying wrapping or packaging film to palletized loads or products wherein the film wrapping apparatus or system is truly portable and transportable so as to readily enable the manual wrapping of palletized loads or products with packaging or wrapping film at a particular location within a production facility, so as to readily enable the manual wrapping of palletized loads or products with packaging or wrapping film at different locations within a particular production facility, or so as to readily enable the manual wrapping of palletized loads or products with packaging or wrapping film at different production facilities.

A last object of the present invention is to provide a new and improved apparatus or system for applying wrapping or packaging film to palletized loads or products wherein the film wrapping apparatus or system is relatively simple in structure, economical to manufacture, and exhibits redundant safety mechanisms for operator personnel.

SUMMARY OF THE INVENTION

The foregoing and other objectives are achieved in accordance with the teachings and principles of the present invention through the provision of a new and improved apparatus or system, for applying packaging film to palletized loads or products disposed at a wrapping station or location, which comprises in effect, a manually movable cart which is formed by means of a chassis wherein a pair of relatively large non-pivotal or non-caster type wheels are mounted upon a rear end portion of the chassis, while a pair of relatively small pivotal or caster-type wheels are mounted upon a front end portion of the chassis so as to permit the cart to be steered. The chassis is also provided with a vertically upstanding mast member, and a film roll carriage, upon which a roll of plastic wrapping film is rotatably disposed so as to be capable of dispensing the plastic wrapping film therefrom, is movably mounted upon the mast member. A counterweight is operatively connected to the film roll carriage, through means of a suitable cable, so as to normally tend to elevate the film roll carriage and the roll of plastic wrapping film mounted thereon. The mast member is provided with a plurality of vertically spaced apertures, and the disposition of a spring-biased, dual-pin bracket system, pivotally mounted with respect to the individual apertures, is able to be controlled by means of a manually-operated cable and lever mechanism.

More particularly, when the lever is squeezed, in a manner similar to that of a hand-operated brake lever upon a bicycle, the cable causes a first end of the pivotally mounted bracket to be moved so as to effectively withdraw a first one of the two pins comprising the dual-pin system to be released from a particular one of the apertures of the mast member while the second end of the pivotally mounted bracket is moved so as to effectively cause the second one of the two pins comprising the dual-pin system to be moved toward the mast member in preparation for insertion within another one of the mast apertures. The film roll carriage, along with the roll of plastic wrapping or packaging film mounted thereon, will be elevated along the mast member under the influence of the downwardly moving counterweight so as to wrap the palletized load or product as the operator pushes the cart along a circular path around the palletized load or product, however, it can be appreciated that the elevation of the film roll carriage is incrementally limited by means of the dual-pin control system.

Accordingly, if continuous spiral wrapping of the palletized load or product is desired to be achieved, the operator simply needs to alternatively squeeze and release the lever so as to permit the film roll carriage to elevationally move upwardly along the mast member as determined by means of the dual-pin control system. Alternatively, if continuous concentric wrap-ping of the palletized load or product with the packaging or wrapping film at a particular elevational level is desired, which is known as reinforcing wrapping, the lever is simply released so as to permit the cable-controlled pin to enter a particular aperture located along the mast member. When such cable-controlled pin enters such aperture upon the mast member, further elevation of the film roll carriage, and the roll of wrapping film mounted thereon, is prevented. At the completion of a wrapping cycle or operation, the operator can manually release the cable-controlled pin independently of the cable-control mechanism such that both pins are effectively simultaneously retracted from their mast apertures thereby permitting the carriage assembly to be lowered to its lowermost position in preparation for a new palletized load or product packaging or wrapping cycle or operation. It can therefore be appreciated that as a result of the alter-natively actuated dual-pin control system, redundant safety is inherently incorporated within the system.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
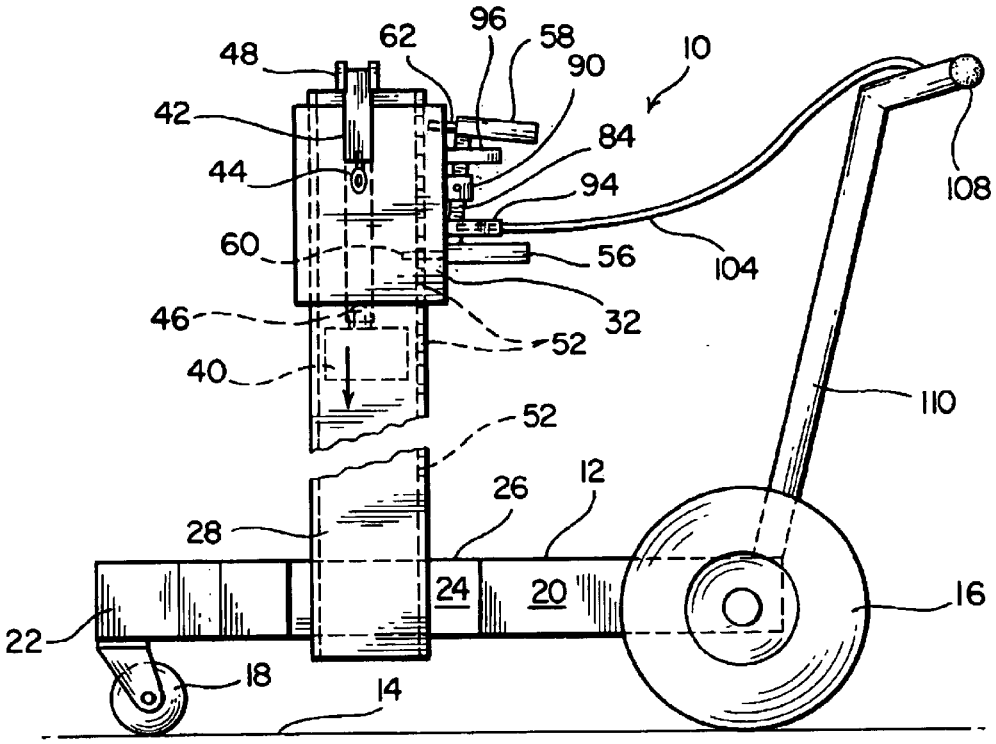
FIG. 1 is a side elevational view of a new and improved portable plastic film wrapping apparatus or system which has been constructed in accordance with the principles and teachings of the present invention and which shows the cooperative parts thereof for use in connection with the wrapping of palletized loads or products within plastic wrapping film, except that the wrapping film supply roll holder and dispensing mechanism have been removed.
Figure 2:
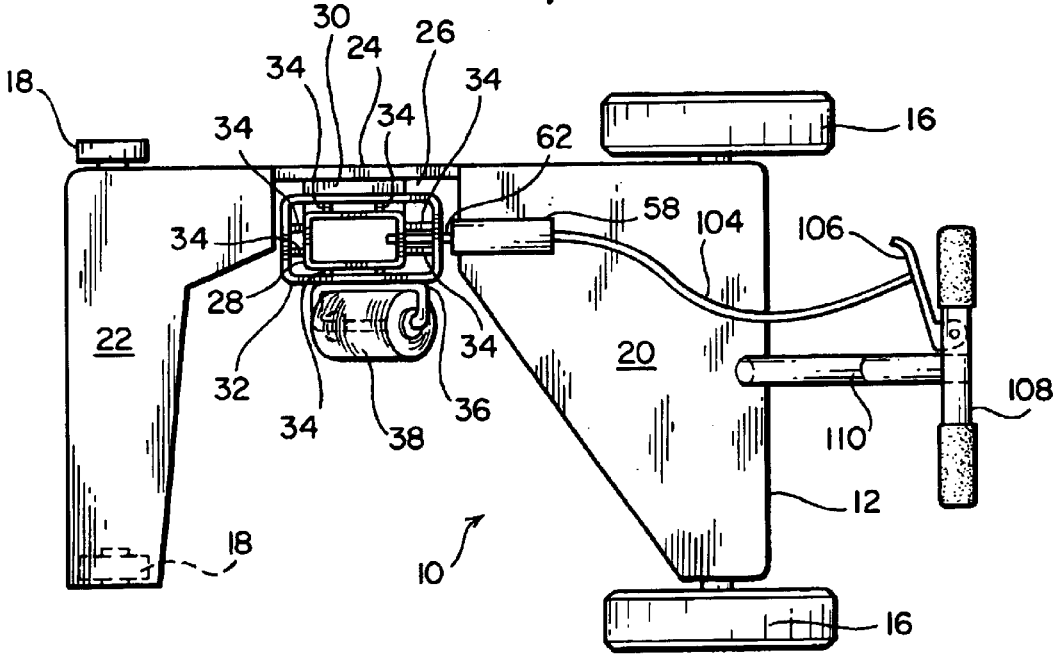
FIG. 2 is a top plan view of the new and improved portable plastic film wrapping apparatus or system as disclosed within FIG. 1, except that the wrapping film supply roll holder and dispensing mechanism have been illustrated.
Figure 3:
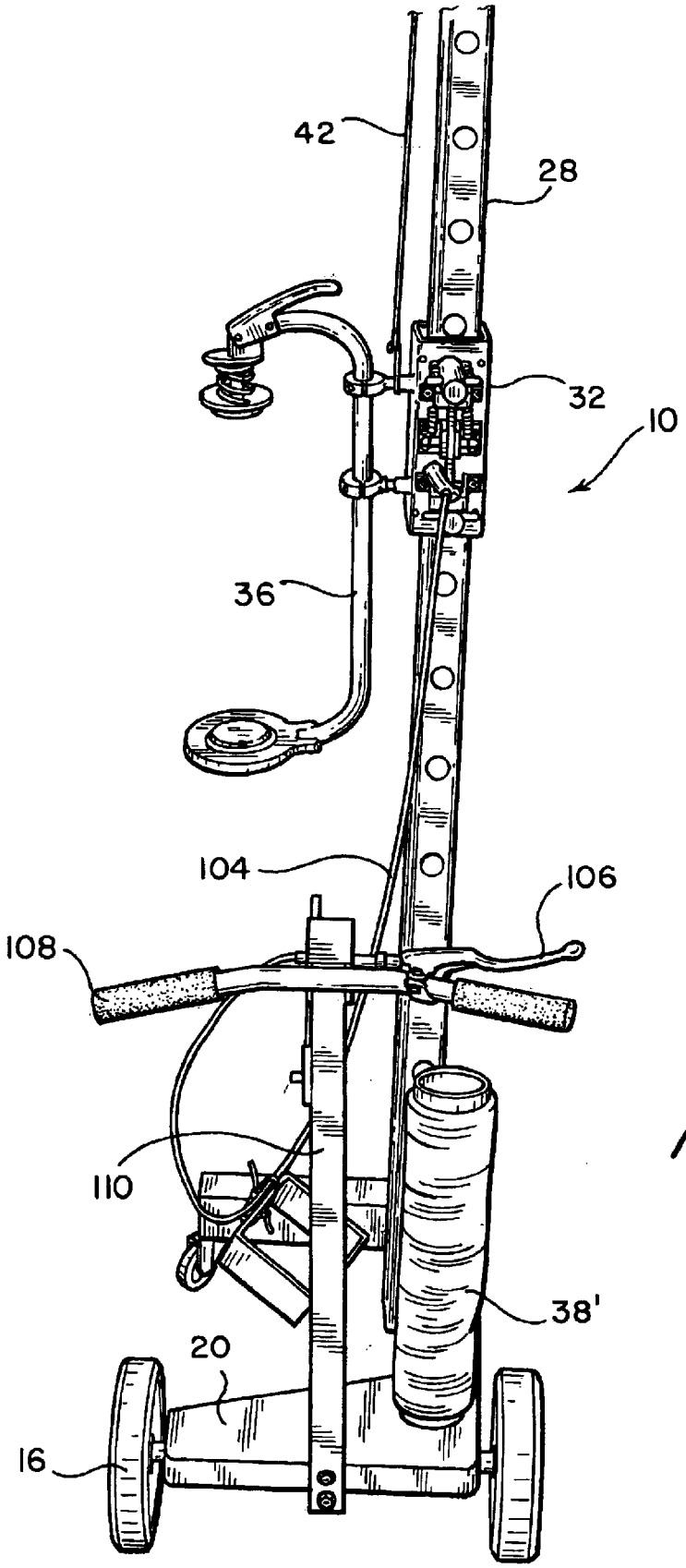
FIG. 3 is a rear elevational view of the new and improved portable plastic film wrapping apparatus or system as disclosed within FIGS. 1 and 2 with the wrapping film supply roll holder and dispensing mechanism being disclosed.

Referring now to the drawings, and more particularly to FIGS. 1–3 thereof, a new and improved portable plastic film wrapping apparatus or system, constructed in accordance with the principles and teachings of the present invention, is disclosed and is generally indicated by the reference character 10. The apparatus or system 10 is mounted upon a movable cart which renders the entire apparatus or system 10 portable and transportable, and it is seen that the movable cart comprises a chassis 12 which is adapted to be rollably supported and moved along a floor or ground region 14 by means of a pair of laterally or transversely spaced, non-pivotal rear wheels 16,16, and a pair of laterally or transversely spaced, pivotal or steerable front caster wheel assemblies 18,18. As best seen from FIG. 2, the chassis 12 substantially comprises a rear chassis section 20 upon which the rear wheels 16,16 are rotatably mounted, and a front chassis section 22 upon which the front caster wheel assemblies 18,18 are mounted. The chassis 12 further includes a side frame member 24, and it is seen that the rear and front chassis sections 20,22 are separated from each other along side frame member 24 so as to effectively define a recessed region 26, between the chassis sections 20,22, within which the lower end portion of a vertically upstanding mast member 28 is adapted to be disposed. More particularly, as best seen in FIGS. 2 and 3, the lower end portion of the upstanding mast member 28 is adapted to be fixedly secured, for example, by means of suitable bolt fasteners, not shown, to a box-beam type support or mounting bracket 30, and the box-beam type support or mounting bracket 30 is, in turn, adapted to be fixedly secured, for example, by means of suitable bolt fasteners, also not shown, to the chassis side frame member 24.

The vertically upstanding mast member 28 comprises a hollow, box-beam structure having a substantially rectangular cross-sectional configuration, and a film roll carriage 32, also having a substantially hollow structure having a substantially rectangular cross-sectional configuration, is adapted to be movably disposed upon the upstanding mast member 28 in an annularly surrounding relationship. In order to readily facilitate the upward and downward movements of the film roll carriage 32 upon the external surfaces of the upstanding mast member 28, a plurality of NYLON® rollers 34 are rotatably mounted upon interior portions of the film roll carriage 32 so as to rollably engage the external surface portions of the upstanding mast member 28. The film roll carriage 32 of course has a film roll mounting and dispensing assembly 36 mounted thereon, and the film roll dispensing and mounting assembly 36 has a supply roll of wrapping film 38 removably mounted thereon as disclosed within FIGS. 2 and 3, a spare supply roll of wrapping film also being disclosed at 38' in FIG. 3.

The weight of the film roll carriage 32, the film roll mounting and dispensing assembly 36, and the roll of wrapping film 38 is adapted to be counterbalanced by means of a counterweight 40, which is actually slightly heavier than the combined weight of the noted components comprising the film roll carriage 32, the film roll mounting and dispensing assembly 36, and a full roll of wrapping film 38 including its core. It is noted that the counterweight 40 is adapted to be mounted internally within the hollow upstanding mast member 28, and the counterweight 40 may comprise either a solid block or a plurality of plates separably secured together. As best seen in FIGS. 1 and 3, the film roll carriage 32 is adapted to be operatively connected to the counterweight 40 by means of a NYLON® web belt 42 wherein the opposite ends of the belt 42 are respectively connected to the film roll carriage 32 and counterweight 40 by means of suitable releasable fasteners 44,46, and it is noted further that the web belt 42 is adapted to be routed over a pulley 48 which is rotatably mounted upon a suitable bracket, not shown, which is integral with the upper end portion of the mast member 28. It is also noted, as can best be appreciated from FIG. 3, that the end of the web belt 42 that is adapted to be connected to the film roll carriage 32 by means of releasable fastener 44 is actually connected to an upper one of a pair of bracket arms 50 which integrally connect or mount the film roll mounting and dispensing assembly 36 to or upon the film roll carriage 32.

Figure 4:
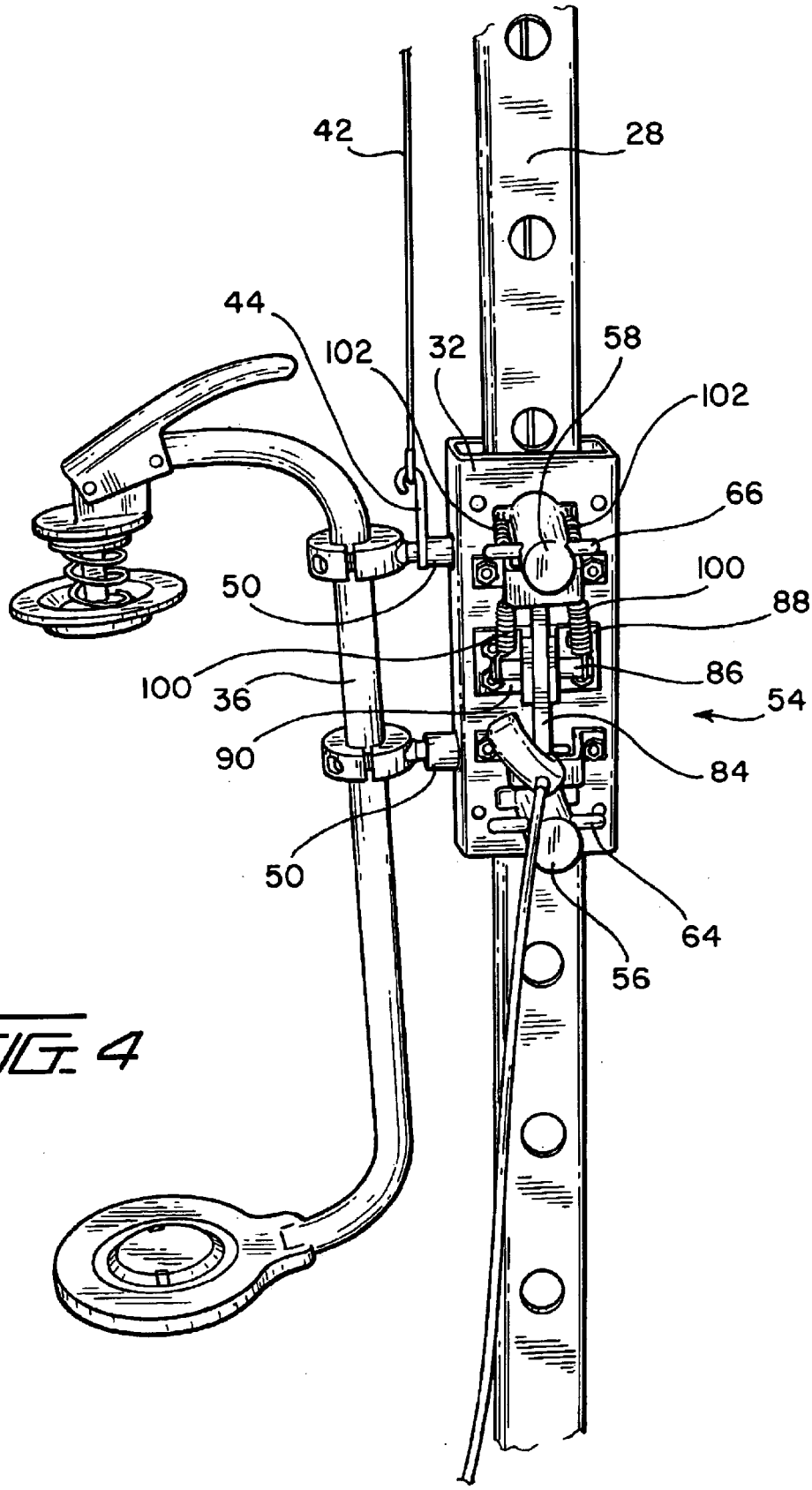
FIG. 4 is a rear elevational view of the new and improved dual-pin redundant control system as constructed in accordance with the principles and teachings of the present invention and showing the operative parts thereof as mounted upon the film supply roll carriage mechanism for operative cooperation with the vertically oriented mast member of the portable plastic film wrapping apparatus or system as disclosed within FIGS. 1–3.
Figure 5:
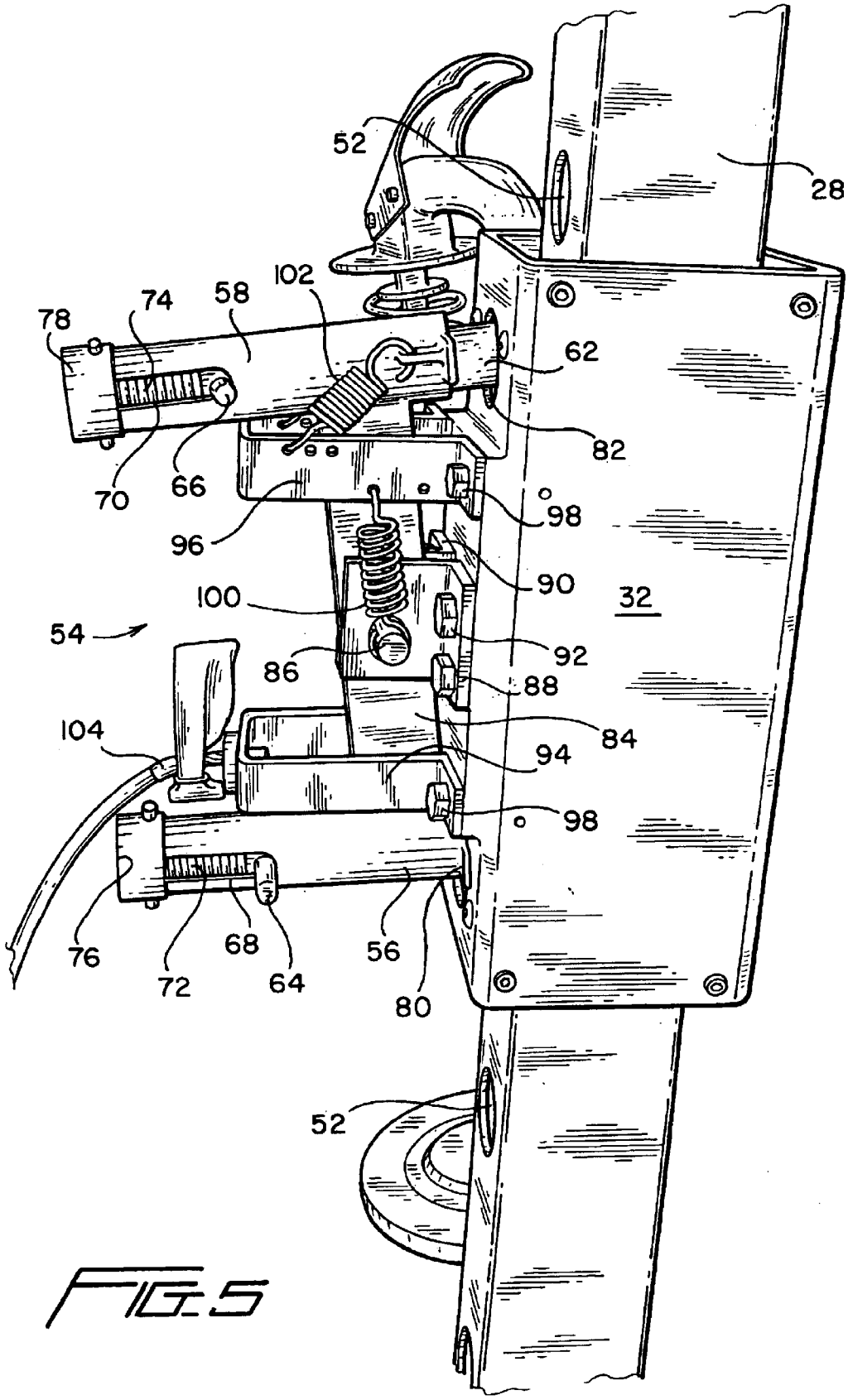
FIG. 5 is an enlarged side elevational view of the new and improved dual-pin redundant control system as disclosed within FIG. 4 showing the details of the interrelated structure comprising the dual-pin redundant control system.

Continuing further, and with additional reference being made to FIGS. 4 and 5, the mast member 28 is provided with a plurality of apertures 52 which are arranged within a vertically spaced array, and the film roll carriage 32 has fixedly mounted thereon, so as to be movable therewith, a redundant dual-stop pin assembly 54 which is adapted to operatively cooperate with the array or set of apertures 52 defined within the mast member 28 so as to fixedly retain the film roll carriage 32 at a particular elevational level along the mast member 28 as may be desired. More particularly, the redundant dual-stop pin assembly 54 is seen to comprise a first lower stop pin cylinder or housing 56 and a second upper stop pin cylinder or housing 58. The first lower stop pin cylinder or housing 56 has a first axially movable stop pin 60, as best seen in FIG. 1, disposed therein, and the second upper stop pin cylinder or housing 58 has a second axially movable stop pin 62 disposed therein. Rear end portions of the movable stop pins 60,62 are respectively provided with transversely extending rods or handles 64,66, and the rear sections of the stop pin cylinders or housings 56,58 are respectively provided with axially oriented slots 68,70 within their side walls through which the transversely oriented rods or handles 64,66 of the movable stop pins 60, 62 project outwardly from the stop pin cylinders or housings 56,58. Coil springs 72,74 are respectively disposed within rear sections of the stop pin cylinders or housings 56,58 so as to be interposed between rear end walls 76,78 of the stop pin cylinders or housings 56,58 and the movable stop pins 60,62, and in this manner, the movable stop pins 60,62 are normally biased in the forward direction toward the film roll carriage 32. The film roll carriage 32 is also provided with first and second lower and upper apertures 80,82 through which the first and second lower and upper movable stop pins 60,62 project so as to in turn alternatively engage the apertures 52 defined within the mast member 28 in accordance with the mode of operation of the redundant dual-stop pin assembly 54 as will become more apparent hereinafter.

With reference still being made primarily to FIG. 5, the first and second lower and upper stop pin cylinders or housings 56,58 are respectively integrally connected to opposite lower and upper end portions of a substantially vertically oriented beam member 84, and it is further appreciated that the substantially vertically oriented beam member 84 has an integral, transversely oriented pivot pin 86 at the central portion thereof. The oppositely extending ends of the pivot pin 86 extend through suitable apertures defined within a pair of L-shaped mounting brackets 88,90 such that the pivot pin 86 is pivotal with respect to the mounting brackets 88,90, and it is seen that the mounting brackets 88,90 are fixedly mounted upon the film roll carriage 32 through means of suitable bolt fasteners 92. First and second lower and upper U-shaped mounting brackets 94,96 are fixedly mounted upon the film roll carriage 32 by means of suitable bolt fasteners 98, and it is seen that the lower and upper sections of the substantially vertically oriented beam member 84 pass between the laterally separated leg portions of each U-shaped mounting bracket 94,96 so as to enable or facilitate the integral connection of the beam member 84 to the stop pin cylinders or housings 56,58 as well as to permit the free consequent movement of the beam member 84 and the integrally attached stop pin cylinders or housings 56,58 with respect to the U-shaped mounting brackets 94,96.

A pair of coil springs 100,100 have opposite ends thereof connected to opposite sides of the upper U-shaped mounting bracket 96 as well as to opposite ends of the pivot pin 86 for assembly integration and stabilization purposes, and another pair of coil springs 102,102 have opposite ends thereof connected to opposite sides of the upper U-shaped mounting bracket 96 as well as to opposite sides of the upper stop pin cylinder or housing 58. In this manner, it can be appreciated that the coil springs 102,102 normally bias or cause the upper stop pin cylinder or housing 58, and therefore the stop pin 62 thereof, to be disposed at a retracted position with respect to the film roll carriage 32 such that, in turn, and more importantly, the upper stop pin 62 is disposed at a withdrawn position with respect to the apertures 52 formed within the upstanding mast member 28. However, in view of the fact that the upper stop pin cylinder or housing 58 is integrally connected to the lower stop pin cylinder or housing 56 through means of the beam member 84, and in view of the fact that the beam member 84 is freely pivotal within the L-shaped mounting brackets 88,90 by means of the pivot pin 86, the lower stop pin cylinder or housing 56 is biased or caused to be disposed at an extended position with respect to the film roll carriage 32 such that, in turn, and more importantly, the lower stop pin 60 is disposed at an inserted or engaged position with respect to a particular one of the apertures 52 formed within the upstanding mast member 28. It is to be further appreciated that in accordance with the principles and teachings of the present invention, and the construction of the aforenoted redundant dual-stop pin assembly 54, one of the upper or lower stop pins 60,62 is always adapted or intended to be engaged with one of the apertures 52 formed within the upstanding mast member 28 so as to facilitate the safe movement of the film roll carriage 32 along the upstanding mast member 28 during a film wrapping or packaging operation or cycle.

More particularly, in order to in fact release the stop pin 60 from a particular one of the apertures 52 defined within the upstanding mast member 28, and thereby permit the film roll carriage 32 to be moved upwardly relative to and along the mast member 28, a first end of a release cable 104 is operatively inserted or passed through the lower U-shaped mounting bracket 94 so as to be operatively connected to the lower end portion of the beam member 84, while a second opposite end of the release cable 104 is operatively connected to a release lever 106. The release lever 106 is pivotally mounted upon a horizontally disposed cross-bar or handle portion 108 which, in turn, is integrally fixed to an upper distal end portion of an upwardly extending, rearwardly inclined support bar 110. The lower end portion of the support bar 110 is fixedly attached to a rear deck portion of the rear chassis section 20, and it can therefore be readily appreciated that the upwardly extending inclined support bar 110 and the horizontally disposed cross-bar or handle 108 are similar in structure to corresponding structural components provided upon, for example, a conventional lawnmower.

It can be readily appreciated still further that the release lever 106 is similar to, for example, a brake lever conventionally provided upon a bicycle, and accordingly, in a manner operatively similar to that employed in connection with such a bicycle brake lever, when the release lever 106 is squeezed or pivoted toward the cross-bar or handle 108, release cable 104 will cause the lower end portion of the beam member 84 and the integrally connected stop pin cylinder or housing 56 to be pivotally moved and therefore retracted rearwardly against the biasing forces of the coil springs 102. The lower stop pin cylinder or housing 56 is effectively integrally or fixedly connected to the lower stop pin 60 as a result of the engagement of the slotted portion 68 of the stop pin cylinder or housing 56 with the transverse pin or handle 64 fixedly connected to the lower stop pin 60, and in this manner, the lower stop pin 60 is caused to be released or withdrawn from a particular one of the apertures 52 formed within the mast member 28. Concomitantly with the aforenoted pivotal movement of the beam member 84, the upper stop pin cylinder or housing 58 will be correspondingly extended toward the mast member 28 so as to in turn cause the upper stop pin 62 to be moved toward and into engagement with the upstanding mast member 28.

Accordingly, at this point in time, since the lower stop pin 60 has now been released from its aperture 52 of the mast member 28, and since the upper stop pin 62 has not yet engaged one of the apertures 52 of the upstanding mast member 28, the counterweight 40 will tend to elevate the film roll carriage 32 upwardly whereby, when the upper stop pin 62 does encounter the next available aperture 52 formed within the upstanding mast member 28, the stop pin 62 will be projected into such aperture 52 thereby arresting further upward movement of the film roll carriage 32. Subsequently, if the release lever 106 is permitted to return to its non-actuated or non-squeezed state, coils springs 102,102 will cause upper stop pin cylinder or housing 58 and upper stop pin 56 to be returned to their original retracted positions at which upper stop pin 56 will be withdrawn from its aperture 52 of the mast member 28. Beam member 84 will therefore again pivotally actuate lower stop pin cylinder or housing 56 and lower stop pin 60 to their extended positions whereby lower stop pin 60 can again engage its next available aperture defined within the upstanding mast member 28. It can therefore be appreciated that during a film packaging or wrapping operation or cycle, by repeatedly actuating the stop pin release lever 106 and its operatively associated release cable 104, the film roll carriage 32 can be permitted to rise along the mast member 28 in a well-controlled and safe incremental manner. In addition, the it can be further appreciated that the frequency of the actuation of the release lever 106 and release cable 104, and therefore the speed or delay with which the film roll carriage 32 is permitted to move along the mast member 28, is of course under the optional control of the operator. This mode of operation therefore permits the operator to achieve different film wrapping modes with the redundant dual-stop pin control system 54 of the present invention.

More particularly, for example, when a plastic film wrapping cycle or operation is to be begin, the film roll carriage 32, having a roll of wrapping film 38 mounted thereon, is initially disposed at the lowermost position whereby the lower stop pin 60 will be at its spring-biased extended position so as to be lockingly engaged within the lowermost one of the plurality of apertures 52 defined within the mast member 28. It is noted, as may best be appreciated from FIG. 2, that the axis of the roll of wrapping film 38 is not in fact vertical but is disposed at a predetermined angle, and the reason for this is that such angular disposition of the wrapping film roll 38 enables the wrapping film to be dispensed therefrom at an orientation which facilitates the uniform spiral wrapping of the film upon the palletized load or product in a substantially flattened state. In addition, in order to properly initiate the wrapping of the palletized load or product within the wrapping film, it is usually desired to wrap the load or product within several layers at the lowermost level so as to reinforce and secure the load upon the pallet, or to provide the product with a firmly tightened or secured bottom region. Accordingly, a free end of the wrap-ping film is initially secured to the palletized load or product in any one of several conventional ways, and while the cart is being pushed around the load or product through several laps or revolutions, the film roll carriage 32 is maintained at its lowermost elevational level as a result of the lower stop pin 60 being maintained within the lowermost aperture 52 defined within the mast member 28.

Subsequently, when it is desired to begin upward movement of the film roll carriage 32 so as to cause elevation of the same and the wrapping of the upper levels of the palletized load or product within the wrapping film, the operator squeezes the release lever 106 which, through means of the release cable 104, causes the lower stop pin 60 to be withdrawn or retracted from the lowermost aperture 52 defined within the mast member 28. Since the film roll carriage 32, through means of the operatively associated lower stop pin 60, has now been effectively released from its locked position with respect to the mast member 28, the counterweight 40 is free to move downwardly thereby causing the film roll carriage 32 to be moved upwardly. It is to be noted that, as has been noted hereinbefore, the weight of the counterweight 40 is slightly greater than the combined weight of the film roll carriage 32, the film roll holder or mounting and dispensing assembly 36, and a full roll of wrapping film 38 including its core, however, the weight of the counterweight 40 must also overcome the frictional forces inherent within the roll of the wrapping film 38 tending to prevent the unwinding thereof, as well as the tension forces within the wrapping film. In other words, such frictional and tension forces are such that when the push cart is stationary and not being pushed, the oppositely acting weight forces characterized by the counterweight 40, and the film roll carriage assembly comprising the film roll carriage 32, the film roll holder or mounting and dispensing assembly 36, and a full roll of wrapping film 38 including its core, are balanced, whereby the counterweight 40 does not in fact descend and does not in turn cause the film roll carriage 32 to ascend.

To the contrary, however, when the operator begins to push the cart along a circular route or path around the palletized load or product, incremental portions of the wrapping film are effectively and automatically continuously unwound from the roll of wrapping film 38 such that the aforenoted frictional forces are accordingly effectively and automatically continuously relieved or overcome. Therefore, the counterweight 40 is now in fact free to descend and cause the film roll carriage 32 to ascend thereby permitting the wrapping film being unwound and dispensed from the roll of wrapping film 38 to be wound around the palletized load or product in a spiral wrapped manner. It is to be particularly appreciated, however, that in accordance with the specific principles and teachings of the present invention, that is, in accordance with the alternative disposition of the two stop pins 60,62 within particular or next-available apertures 52 defined within the mast member 28, the film roll carriage 32 can never experience an uncontrolled rise to the top of the upstanding mast member 28 in response to an uncontrolled free-fall movement of the counterweight 40. Accordingly, the dual-stop pin 60,62 structural arrangement characteristic of the present invention mandates and ensures the safe operation of the film wrapping or packaging apparatus or system 10 of the present invention.

Continuing further, if desired, the foregoing wrapping mode of operation can be substantially continuous in accordance with the aforenoted incrementally stepped control movement of the film roll carriage 32 whereby the entire vertical extent of the palletized load or product can be accordingly wrapped within the wrapping film. However, different types of wrapping modes are often desired to be performed in connection with the wrapping of a palletized load or product within plastic wrapping film. For example, reinforcing wrapping, comprising the application of a plurality of concentric layers of wrapping film at a predetermined elevational level, may be desired to be applied to and wrapped around the load or product, or different sections of the load or product may be desirably wrapped in wrapping film having predetermined amounts or degrees of overlap. In order to achieve reinforcing wrapping of the wrapping film upon the palletized load or product, the release lever 106 is simply released by the operator so as to no longer be disposed in its squeezed or activated state, and accordingly, the coil springs 102 will tend to bias the lower stop pin 60 toward its extended position as has been discussed hereinbefore. Consequently, the film roll carriage 32 will no longer ascend as a result of the lower stop pin 60 being lockingly engaged within a particular one of the apertures 52 of the mast member 28 thereby locking the film roll carriage 32 at such elevational level. Therefore, as the push cart continues to be pushed or moved around the circular path or route, wrapping film will be unwound from the wrapping film roll 38 and concentrically applied to the palletized load or product in its reinforcing mode. In order to terminate the reinforcing or concentric wrapping mode and against institute or achieve a spiral wrapping mode of the wrapping film, it is only necessary that the release lever 106 again be squeezed by the operator so as to withdraw or retract the lower stop pin 60 from the particular aperture 52 defined within the mast member 28 whereby the film roll carriage 32 will again be free to ascend in the aforenoted incrementally controlled manner.

It is to be noted that the vertical serial array of apertures 52 as defined within the mast member 28 have been provided at predetermined locations within the mast member 28, that is, adjacent apertures 52 are all vertically spaced apart through means of a vertical center-to-center distance of four and one-half inches (4.50"). Since the width of conventional wrapping film is eighteen inches (18.00"), the distance defined between each set of two adjacent apertures 52,52 comprises or equals one-quarter of the width of the wrapping film. Therefore, in accordance with another desirable mode of wrapping of the wrapping film upon the palletized load or product, if successive layers of the wrapping film are to be applied with a predetermined amount of overlap, the stop pin 60 can be lockingly disposed within a first one of the apertures 52 defined within the mast member 28, one or more layers of wrapping film material can then be wrapped around the load or product at that elevational level, the release lever 106 can then be briefly actuated and deactuated whereby the lower stop pin 60 will be retracted or withdrawn the particular aperture 52 defined within the mast member 28 and then be disposed within its next aperture 52 defined within the mast member 28 as film roll carriage 32 ascends along the mast member 28 so as to lockingly retain the film roll carriage 32 at the new elevational level, and the wrapping film can be wrapped around the load or product at the new elevational level.

Since the distance defined between adjacent apertures 52 defined within the mast member 28 equals one-quarter of the width of the wrapping film, then the sets of layers of the wrapping film are in effect separated or vertically offset from each other by twenty-five percent (25%) of the width of the wrapping film whereby the overlapped extent defined between such sets of film layers will be seventy-five percent (75%). In a similar manner, if the film roll carriage 32 is locked by means of the lower stop pin 60 at a second mast aperture 52 which is spaced two apertures away from the original mast aperture 52, then the sets of layers of wrapping film are in effect separated or vertically offset from each other by fifty percent (50%) of the width of the wrapping film whereby the overlapped extent defined between such sets of film layers will likewise be fifty percent (50%), while if the film roll carriage 32 is locked by means of the lower stop pin 60 at a second mast aperture 52 which is spaced three apertures away from the original mast aperture 52, then the sets of layers of wrapping film are in effect separated or vertically offset from each other by seventy-five percent (75%) of the width of the wrapping film whereby the overlapped extent defined between such sets of film layers will be twenty-five percent (25%).

It is also to be noted that should the release cable 104 break or otherwise become inoperative, or alternatively, at the conclusion of a film wrapping or packaging operation or cycle at which time the film roll carriage 32 is disposed at the top of the load being wrapped or packaged and it is desired to move the film roll carriage 32 back to its original lowered START position, lower stop pin 60 can be manually released from a particular one of the apertures 52 defined within the mast member 28 by simply pulling rearwardly upon the handle 64 against the biasing force of the coil spring 72. It can be appreciated that this movement of the lower stop pin 60 is independent of the movement of the lower stop pin cylinder or housing 56 whereby the disposition of the upper stop pin cylinder or housing 58, and its associated stop pin 62, is not affected.

It is lastly noted in connection with particular film wrapping operations, while it is usually preferred that the wrapping mode proceed upwardly from the bottom of the load or product whereby successively applied wrapping layers are then disposed upon the load or product in an overlapped mode similar to the disposition of shingles upon a building roof so as to protect the load or product from exposure and weather conditions, it is sometimes desired to wrap the load or product in accordance with a wrapping mode which proceeds downwardly from the top of the load or product. In accordance with the principles and teachings of the present invention, and as afforded by means of the unique structural arrangement of the various components of the film wrapping apparatus or system 10 of the present invention, such an alternative mode of operation is readily able to be achieved. In order to in fact achieve such mode of operation, the entire dual-stop pin structural system or assembly 54 simply needs to be unbolted from the film roll carriage 32, effectively inverted 180°, and rebolted to the film roll carriage 32. This is why the entire structure of the assembly or system 54 is effectively symmetrical about the pivot axis defined by means of pivot pin 86. In other words, both the lower and upper stop pin housings 56,58 are essentially alike, each one of the housings 56,58 is provided with a spring-biased stop pin 60,62 and handle portion 64,66, the beam member 84 comprises substantially identical upper and lower portions, and the lower and upper U-shaped mounting brackets 94,96 are substantially the same. As a result of such new disposition or orientation of the stop pin housings 56,58 upon the film roll carriage 32, it will be appreciated that the lower stop pin 60 has likewise been effectively inverted 180° so as to now comprise the upper stop pin whereby such stop pin 60 is still operatively associated with the release cable 104 and release lever 106 so as to nevertheless still incrementally control the movement of the film roll carriage 32.

The counterweight web belt 42 is quickly and readily disconnected from the film roll carriage 32, and simply secured, for example, to another portion of the mast member 28 so as not to be dislodged from the pulley 48 or to be accidentally disposed within the hollow mast member 28, however, in view of the disposition of the dual stop pins 60,62 with respect to the apertures 52 defined within the mast member 28, the film roll carriage 32 will be maintained at a particular elevation along the mast member 28 and cannot move downwardly along or with respect to mast member 28 unless what is now the upper stop pin 60 is firstly retracted or withdrawn from the particular aperture 52 of the mast member 28. Consequently, in order to achieve a film wrapping operation under this structural arrangement, the film roll carriage 32 is initially moved upwardly, the stop pin 60 being effectively manually retracted, and maintained retracted, from or with respect to the apertures 52 of the mast member 28, and when the film roll carriage 32 is disposed at the desired elevational level, the stop pin 60 is released so as to automatically snap into the adjacent aperture 52 defined within the mast member 28 thereby holding the film roll carriage 32 at that elevational level.

Subsequently, in order to permit the film roll carriage 32 to descend under its own weight, and as a result of the additional relief or release of the frictional forces normally present within the wrapping film but relieved or released as a result of the movement of the portable cart by the operator, as has been discussed hereinbefore, the stop pin 60, which is now the upper stop pin, is withdrawn or retracted from the particular aperture 52 of the mast member 28 in response to movement of the same through means of the release cable 104, whereby, for example, the normal spiral wrapping operation can proceed in accordance with the controlled incremental manner as determined by means of both of the dual stop pins 60,62. It can be further appreciated that the other wrapping modes of operation, which have been previously discussed in connection with the upwardly directed wrapping of a load or product, can likewise be achieved, and consequently, a detailed description of the same will be omitted herefrom in the interests of brevity.

Thus, it may be seen that in accordance with the principles and teachings of the present invention, a new and improved film wrapping apparatus or system has been developed which is extremely simple in structure, wherein the same is truly portable and transportable, and wherein further, the apparatus or system is readily capable of performing various different wrapping modes upon a palletized load or product, and in both upwardly and downwardly proceeding directions. It is to be especially appreciated that as a result of the provision of the redundant dual-stop pin system, the ascent or descent of the film roll carriage can be reliably achieved in a safely controlled manner.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Portable apparatus adapted to be moved along a circular locus around an article disposed at a wrapping station so as to be capable of wrapping the article in wrapping film, comprising:

a manually movable portable push-cart;

a vertical mast member mounted upon said portable push-cart and having a plurality of vertically spaced apertures defined therein;

a film roll carriage vertically movable upon said vertical mast member;

a roll of wrapping film mounted upon said film roll carriage; and a dual-stop pin mechanism operatively mounted upon said film roll carriage and comprising a pair of stop pins which are operatively connected together so as to be alternatively movable between first extended and second retracted positions such that when a first one of said pair of stop pins is moved toward said first extended position so as to be operatively engaged with one of said plurality of vertically spaced apertures defined within said mast member in order to lockingly retain said film roll carriage at a particular elevational position with respect to said vertical mast member, a second one of said pair of stop pins is moved toward said second retracted position so as to be operatively disengaged from said plurality of vertically spaced apertures defined within said mast member, and alternatively, when said first one of said pair of stop pins is moved toward said second retracted position so as to be operatively disengaged from said plurality of vertically spaced apertures defined within said mast member, said second one of said pair of stop pins is moved toward said first extended position so as to be operatively engaged with one of said plurality of vertically spaced apertures defined within said mast member so as to lockingly retain said film roll carriage at a particular elevational position with respect to said vertical mast member, whereby said film roll carriage can be safely moved along said vertical mast member in an incremental manner.

2. The apparatus as set forth in claim 1, wherein:

said pair of stop pins are fixedly mounted upon a common beam member operatively connecting said pair of stop pins together.

3. The apparatus as set forth in claim 2, wherein:

opposite ends of said common beam member are fixedly connected to said pair of stop pins; and a central portion of said common beam member is pivotally mounted upon said film roll carriage by means of a pivot pin.

4. The apparatus as set forth in claim 2, wherein:

said first and second stop pins are respectively disposed within first and second stop pin housings; and said common beam member is integrally connected to said first and second stop pin housings.

5. The apparatus as set forth in claim 4, further comprising:

first and second spring members respectively disposed within each one of said first and second stop pin housings so as to normally bias said first and second stop pins toward extended positions with respect to said first and second stop pin housings; and a handle mounted upon each one of said first and second stop pins by means of which each one of said first and second stop pins can be moved independently of any movement of said first and second stop pin housings and against the biasing forces of said first and second spring members from said extended positions with respect to said first and second stop pin housings to retracted positions with respect to said first and second stop pin housings.

6. The apparatus as set forth in claim 3, further comprising:

a release lever operatively mounted upon said manually movable portable push-cart; and a release cable having a first end portion thereof operatively connected to said release lever and a second end portion thereof operatively connected to a first end of said common beam member whereby when said release lever is actuated, said release cable will cause said common beam member to pivot upon said pivot pin from a first position to a second position so as to cause first one of said first and second stop pins to be moved from said first extended position to said second retracted position so as to operatively disengage said first one of said first and second stop pins from one of said apertures defined within said mast member, while said second one of said first and second stop pins is moved from said second retracted position to said first ex-tended position so as to operatively engage one of said apertures defined within said mast member.

7. The apparatus as set forth in claim 6, further comprising:

a mounting bracket fixedly mounted upon said film roll carriage; and a spring member operatively connected to said mounting bracket and to a second end of said common beam member such that when said release lever is deactuated, said spring member will pivotally bias said common beam member back to said first position whereby said first one of said first and second stop pins will be moved from said second retracted position to said first extended position so as to again operatively engage one of said apertures defined within said mast member, while said second one of said first and second stop pins will be moved from said first extended position to said second retracted position so as to again be operatively disengaged from one of said apertures defined within said mast member.

8. The apparatus as set forth in claim 6, wherein:

said common beam member and said first and second stop pin housings are capable of being mounted upon said film roll carriage in either one of two different orientations 180° apart such that when said common beam member and said first and second stop pin housings are mounted upon said film roll carriage within a first one of said two different orientation modes, said film roll carriage will be able to undergo operatively controlled movement in a first direction along said mast member, whereas when said common beam member and said first and second stop pin housings are mounted upon said film roll carriage within a second one of said two different orientation modes, said film roll carriage will be able to undergo operatively controlled movement in a second direction along said mast member.

9. The apparatus as set forth in claim 1, wherein:

said roll of wrapping film is mounted upon said film roll carriage at a predetermined angle with respect to a vertical plane so as to facilitate spiral wrapping of the wrapping film upon the article.

10. The apparatus as set forth in claim 1, wherein:

said wrapping film has a width dimension of approximately eighteen inches (18.00"); and said plurality of apertures defined within said mast member are spaced approximately four inches (4.00") apart, whereby when said first stop pin is successively engaged within adjacent apertures defined within said mast member, concentrically wound layers of said wrapping film will exhibit an overlap of seventy-five percent (75%) of said wrapping film, whereas when said first stop pin is successively engaged within apertures spaced apart by one aperture defined within said mast member, concentrically wound layers of said wrapping film will exhibit an overlap of fifty percent (50%) of said wrapping film, whereas when said stop pin is successively engaged within apertures spaced apart by two apertures defined within said mast member, concentrically wound layers of said wrapping film will exhibit an overlap of twenty-five percent (25%) of said wrapping film.

11. The apparatus as set forth in claim 1, further comprising:

a pulley member rotatably mounted upon said mast member; and a belt member disposed around said pulley member and having a first end portion thereof operatively connected to said film roll carriage, and a second end portion thereof connected to said counterweight.

12. The apparatus as set forth in claim 1, further comprising:

a counterweight operatively connected to said film roll carriage for effectively counterbalancing said film roll carriage and said roll of wrapping film mounted thereon.

13. Portable apparatus adapted to be moved along a circular locus around an article disposed at a wrapping station so as to be capable of wrapping the article in wrapping film, comprising:

a manually movable portable push-cart;

a vertical mast member mounted upon said portable push-cart and having a plurality of vertically spaced apertures defined therein;

a film roll carriage vertically movable upon said vertical mast member;

a roll of wrapping film mounted upon said film roll carriage;

a counterweight operatively connected to said film roll carriage for effectively counterbalancing said film roll carriage and said roll of wrapping film mounted thereon such that when said manually movable portable push-cart is moved along the circular locus around the article disposed at the wrapping station so as to unwind said wrapping film from said roll of wrapping film and thereby wrap the article within said wrapping film as said wrapping film is being unwound from said roll of wrapping film, said counterweight will descend causing said film roll carriage and said roll of wrapping film mounted thereon to ascend so as to spirally wrap the article within said wrapping film, whereas when the movement of said push-cart along the circular locus around the article disposed at the wrapping station is terminated so as to no longer unwind said wrapping film from said roll of wrapping film, said counterweight will be maintained elevationally stationary so as to in turn maintain said film roll carriage elevationally stationary; and a dual-stop pin mechanism operatively mounted upon said film roll carriage and comprising a pair of stop pins which are operatively connected together so as to be alternatively movable between first extended and second retracted positions such that when a first one of said pair of stop pins is moved toward said first extended position so as to be operatively engaged with one of said plurality of vertically spaced apertures defined within said mast member in order to lockingly retain said film roll carriage at a particular elevational position with respect to said vertical mast member, a second one of said pair of stop pins is moved toward said second retracted position so as to be operatively disengaged from said plurality of vertically spaced apertures defined within said mast member, and alternatively, when said first one of said pair of stop pins is moved toward said second retracted position so as to be operatively disengaged from said plurality of vertically spaced apertures defined within said mast member, said second one of said pair of stop pins is moved toward said first extended position so as to be operatively engaged with one of said plurality of vertically spaced apertures defined within said mast member so as to lockingly retain said film roll carriage at a particular elevational position with respect to said vertical mast member, whereby said film roll carriage can be safely moved along said vertical mast member in an incremental manner.

14. The apparatus as set forth in claim 13, wherein:

said pair of stop pins are fixedly mounted upon a common beam member operatively connecting said pair of stop pins together.

15. The apparatus as set forth in claim 14, wherein:

opposite ends of said common beam member are fixedly connected to said pair of stop pins; and a central portion of said common beam member is pivotally mounted upon said film roll carriage by means of a pivot pin.

16. The apparatus as set forth in claim 14, wherein:

said first and second stop pins are respectively disposed within first and second stop pin housings; and said common beam member is integrally connected to said first and second stop pin housings.

17. The apparatus as set forth in claim 16, further comprising:

first and second spring members respectively disposed within each one of said first and second stop pin housings so as to normally bias said first and second stop pins toward extended positions with respect to said first and second stop pin housings; and a handle mounted upon each one of said first and second stop pins by means of which each one of said first and second stop pins can be moved independently of any movement of said first and second stop pin housings and against the biasing forces of said first and second spring members from said extended positions with respect to said first and second stop pin housings to retracted positions with respect to said first and second stop pin housings.

18. The apparatus as set forth in claim 15, further comprising:

a release lever operatively mounted upon said manually movable portable push-cart; and a release cable having a first end portion thereof operatively connected to said release lever and a second end portion thereof operatively connected to a first end of said common beam member whereby when said release lever is actuated, said release cable will cause said common beam member to pivot upon said pivot pin from a first position to a second position so as to cause first one of said first and second stop pins to be moved from said first extended position to said second retracted position so as to operatively disengage said first one of said first and second stop pins from one of said apertures defined within said mast member, while said second one of said first and second stop pins is moved from said second retracted position to said first extended position so as to operatively engage one of said apertures defined within said mast member.

19. The apparatus as set forth in claim 18, further comprising:

a mounting bracket fixedly mounted upon said film roll carriage; and a spring member operatively connected to said mounting bracket and to a second end of said common beam member such that when said release lever is deactuated, said spring member will pivotally bias said common beam member back to said first position whereby said first one of said first and second stop pins will be moved from said second retracted position to said first extended position so as to again operatively engage one of said apertures defined within said mast member, while said second one of said first and second stop pins will be moved from said first extended position to said second retracted position so as to again be operatively disengaged from one of said apertures defined within said mast member.

20. The apparatus as set forth in claim 18, wherein:

said common beam member and said first and second stop pin housings are capable of being mounted upon said film roll carriage in either one of two different orientations 180° apart such that when said common beam member and said first and second stop pin housings are mounted upon said film roll carriage within a first one of said two different orientation modes, said film roll carriage will be able to undergo operatively controlled movement in a first direction along said mast member, whereas when said common beam member and said first and second stop pin housings are mounted upon said film roll carriage within a second one of said two different orientation modes, said film roll carriage will be able to undergo operatively controlled movement in a second direction along said mast member.

21. The apparatus as set forth in claim 13, wherein:

said roll of wrapping film is mounted upon said film roll carriage at a predetermined angle with respect to a vertical plane so as to facilitate spiral wrapping of the wrapping film upon the article.

22. The apparatus as set forth in claim 13, wherein:

said wrapping film has a width dimension of approximately eighteen inches (18.00"); and said plurality of apertures defined within said mast member are spaced approximately four inches (4.00") apart, whereby when said first stop pin is successively engaged within adjacent apertures defined within said mast member, concentrically wound layers of said wrapping film will exhibit an overlap of seventy-five percent (75%) of said wrapping film, whereas when said first stop pin is successively engaged within apertures spaced apart by one aperture defined within said mast member, concentrically wound layers of said wrapping film will exhibit an overlap of fifty percent (50%) of said wrapping film, whereas when said stop pin is successively engaged within apertures spaced apart by two apertures defined within said mast member, concentrically wound layers of said wrapping film will exhibit an overlap of twenty-five percent (25%) of said wrapping film.

23. The apparatus as set forth in claim 13, further comprising:

a pulley member rotatably mounted upon said mast member; and a belt member disposed around said pulley member and having a first end portion thereof operatively connected to said film roll carriage, and a second end portion thereof connected to said counterweight.

* * * * *